US007674054B2

(12) United States Patent
Vorhees

(10) Patent No.: US 7,674,054 B2
(45) Date of Patent: Mar. 9, 2010

(54) SYSTEM AND METHOD FOR INDICATING RECEIPT PAPER SUPPLY IN A RECEIPT PRINTER

(75) Inventor: Kevin H. Vorhees, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 486 days.

(21) Appl. No.: 11/611,253

(22) Filed: Dec. 15, 2006

(65) Prior Publication Data

US 2008/0142631 A1 Jun. 19, 2008

(51) Int. Cl.
*B65H 43/00* (2006.01)

(52) U.S. Cl. ..... 400/613; 242/563.2

(58) Field of Classification Search ..... 400/613; 347/104; 242/563.1, 563.2
See application file for complete search history.

(56) References Cited

U.S. PATENT DOCUMENTS

| | | | | |
|---|---|---|---|---|
| 4,239,404 | A | 12/1980 | DeFilipps et al. | |
| 4,913,366 | A * | 4/1990 | Andou | 242/563.2 |
| 4,925,121 | A * | 5/1990 | Tapscott et al. | 242/563.2 |
| 5,607,121 | A * | 3/1997 | Boriani et al. | 242/563.2 |
| 6,356,670 | B1 * | 3/2002 | Keithley et al. | 382/300 |
| 6,639,669 | B2 | 10/2003 | Hubble, III et al. | |
| 6,661,979 | B2 | 12/2003 | Barlow | |

OTHER PUBLICATIONS

"Palette: A Paper Interface for Giving Presentations," L. Nelson, S. Ichimura, E.R. Pedersen, Papers, CHI 99, May 15-20, 1999, (pp. 354-361).

* cited by examiner

*Primary Examiner*—Judy Nguyen
*Assistant Examiner*—Jennifer Simmons
(74) *Attorney, Agent, or Firm*—Cantor Colburn LLP; Mark McBurney

(57) ABSTRACT

Disclosed is a system for indicating paper supply in receipt printers, the system including a paper roll including a core and length of paper that forms a paper portion, the core including a core diameter and the paper portion including a decreasing paper diameter, wherein the core contrasts in color to the paper portion to create a contrast, a scanner configured to sense data pertaining to areas occupied by the core and the paper portion via the contrast, wherein the computing resource is configured to convert the data into measurements of the core diameter and paper diameter, the computing resource being programmable to create alerts when remaining lengths of paper are left on the paper roll, the remaining lengths corresponding to low paper conditions of the paper roll, and being calculated by measurements pertaining to the core diameter, decreasing paper diameter, and a thickness of the paper.

2 Claims, 4 Drawing Sheets

SYSTEM AND METHOD FOR INDICATING RECEIPT PAPER SUPPLY IN A RECEIPT PRINTER

BACKGROUND OF THE INVENTION

1. Field of the Invention

The disclosure relates generally to a system and method for indicating receipt paper supply in a receipt printer, and more particularly to a system and method for indicating low paper conditions in a receipt printer.

2. Description of the Background

Traditionally, receipt paper rolls are marked with a pink stripe near an end of the paper (i.e., the end of the length of paper comprising the paper roll). This pink stripe is used to alert an operator that the roll is nearing the end of its supply, and needs to be replaced soon.

Instead of using this pink stripe however, some commercial users of receipt paper employ low paper sensing devices (i.e., low paper scanners) that detect when receipt rolls are nearing the end of their supply. Commercial users, such as high-end stores that do not want to give out a receipt that includes a pink stripe and stores with unattended and self-checkout stations, often fall into this category. The low paper scanners used may be mechanical, such as limit switches, or optical, such as single channel reflectors. A drawback to these types of scanners is that they must be mechanically adjusted by a user to compensate for an outer diameter of a core portion of the paper roll, paper thickness, and desired length of remaining paper to set the alert. Since core portions, paper thickness, and desired length of remaining paper is variable among a set of customers, initial adjustment can be time consuming and inaccurate.

Since different receipt paper users desire different "low points" on the paper portion of the roll (typically anywhere from 1-15 feet from the end of the roll), it is impossible for receipt paper roll manufacturers to provide determine a uniform point for marking on the paper roll. Thus, manufacturers sell paper rolls that are low point marked at over different lengths, typically from 5 to 15 feet from the end of the roll. This variation, particularly in cases where one store uses rolls with different low point markings for different applications, can lead to confusion, and usage of rolls with undesirable low point markings for a specific application.

As such, a low paper sensing system that can both conveniently adjust to variation in core outer diameter and paper thickness and be conveniently adjusted to match a desirable low point for a specific user/application, is desirable.

SUMMARY OF THE INVENTION

Disclosed is a system for indicating receipt paper supply in a receipt printer, the system including a receipt paper roll including a roll core and a length of receipt paper wound around the roll core to form a rolled paper portion, the roll core including a core diameter and the rolled paper portion including a paper diameter that is configured to decrease during normal operation of the printer, wherein the roll core of the receipt paper roll is contrasting in color to the rolled paper portion of the receipt paper roll to create a detectable contrast, an optical scanner logically associated with a computing resource that is logically associated with the printer, the scanner being disposed so that the receipt paper roll is within a line of sight of the scanner, the scanner being configured to sense data pertaining to areas of the receipt paper roll occupied by the roll core and the rolled paper portion via the detectable contrast, wherein the computing resource is configured to convert the data detected by the optical scanner into measurements pertaining to the core diameter and the decreasing paper diameter, the computing resource being programmable to create at least one alert when at least one remaining length of the length of receipt paper is left on the receipt paper roll, at least one of the at least one alert and at least one of the at least one remaining length corresponding to a low paper condition of the receipt paper roll, and the at least one remaining length being calculated by the measurements pertaining to the core diameter and the decreasing paper diameter coupled with a thickness measurement of the length of receipt paper, a display device disposed with at least one of the printer, the scanner, and the computing resource, the display device being logically associated with the computing resource and configured to display to the at least one alert.

Also disclosed is a method for indicating receipt paper supply in a receipt printer, the method including disposing a length of receipt paper around a roll core to create a receipt paper roll, wherein the length of receipt paper forms a rolled paper portion around the roll core, the roll core being of a contrasting color to the rolled paper portion, creating a detectable color contrast between the roll core and the rolled paper portion via the contrasting color of the roll core, scanning the roll core and the paper portion with an optical scanner logically associated with a computing resource, distinguishing between the roll core and the rolled paper portion with the optical scanner via the detectable color contrast, transmitting data pertaining to the roll core and the rolled paper portion from the scanner to the computing resource, computing the data to create measurements pertaining to a paper diameter of the rolled paper portion and a core diameter of the roll core, the paper diameter decreasing with usage of the paper supply, programming the computing resource to create at least one alert when at least one remaining length of the length of paper is reached on the roll, the at least one alert and the remaining length corresponding to a low paper condition, calculating said at least one remaining length via the measurements pertaining to the core diameter, the measurements pertaining to the decreasing paper diameter, and measurements pertaining to paper thickness of the length of receipt paper, and alerting the low paper condition to a user.

BRIEF DESCRIPTION OF THE DRAWINGS

The foregoing and other features and advantages of the present invention should be more fully understood from the following detailed description of illustrative embodiments taken in conjunction with the accompanying Figures in which like elements are numbered alike in the several Figures.

DETAILED DESCRIPTION OF THE INVENTION

Figure 1:
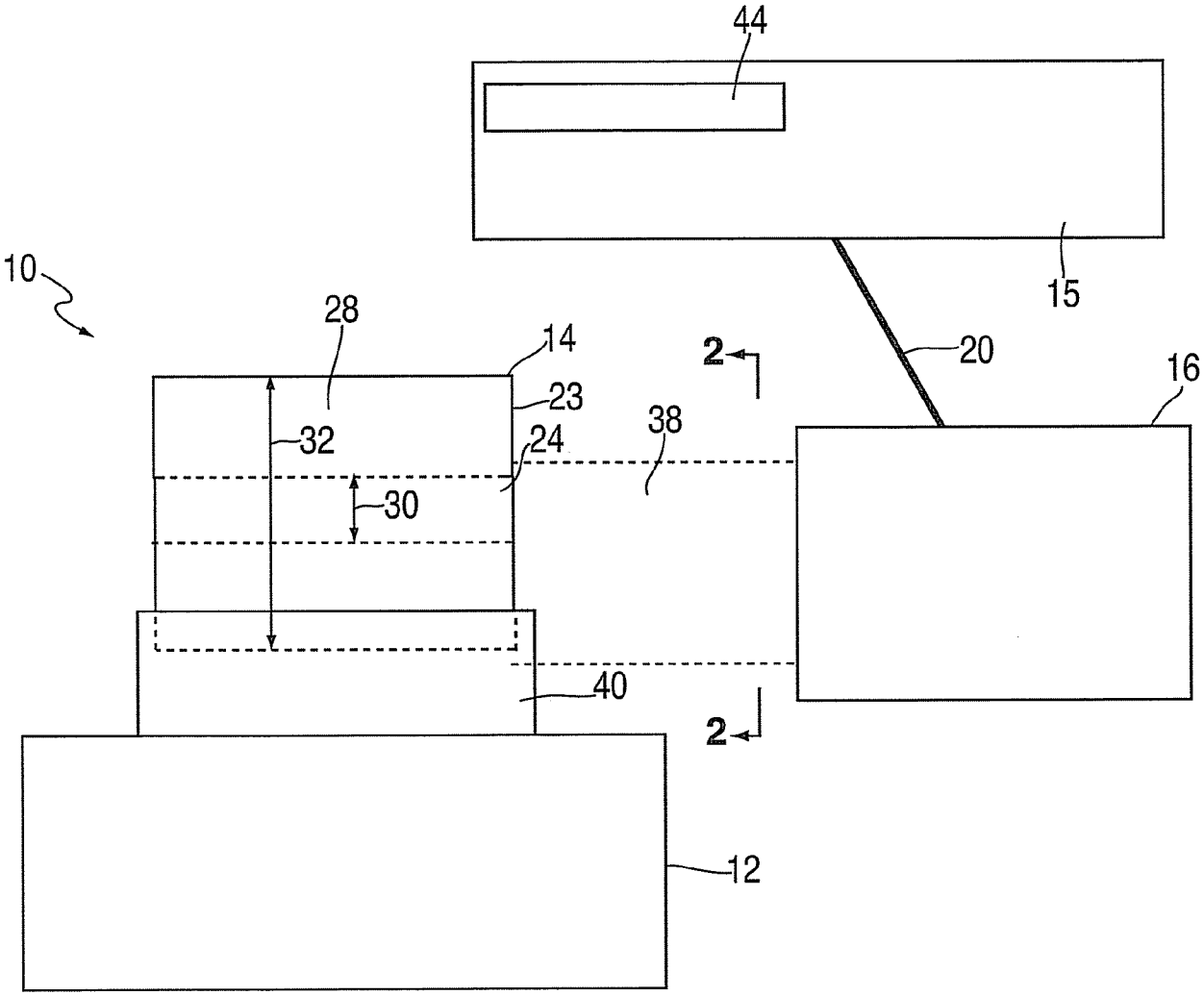
FIG. 1 is a schematic side perspective of a system for indicating receipt paper supply in a receipt printer.
Figure 2:
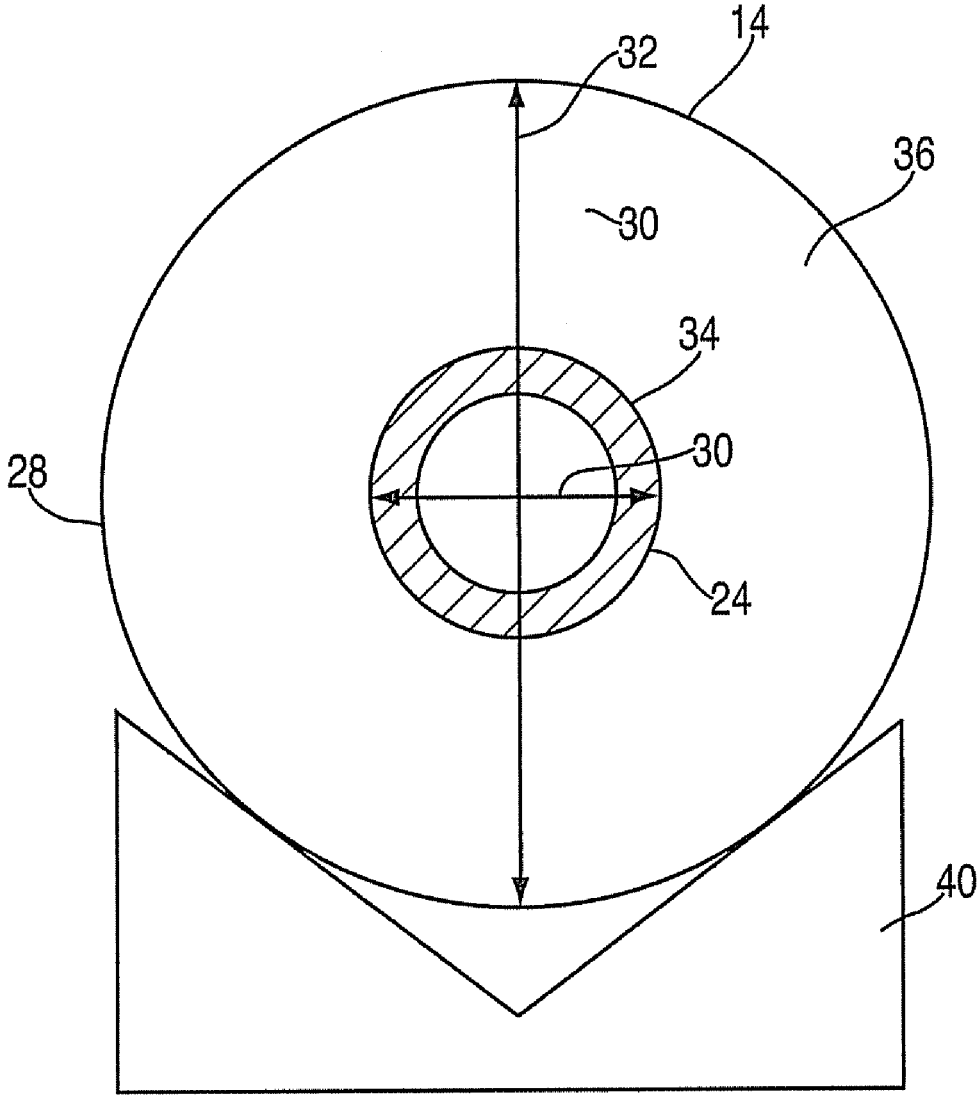
FIG. 2 is a partial schematic of the system for indicating receipt paper supply in the receipt printer taken along line 2-2 of FIG. 1.
Figure 3:
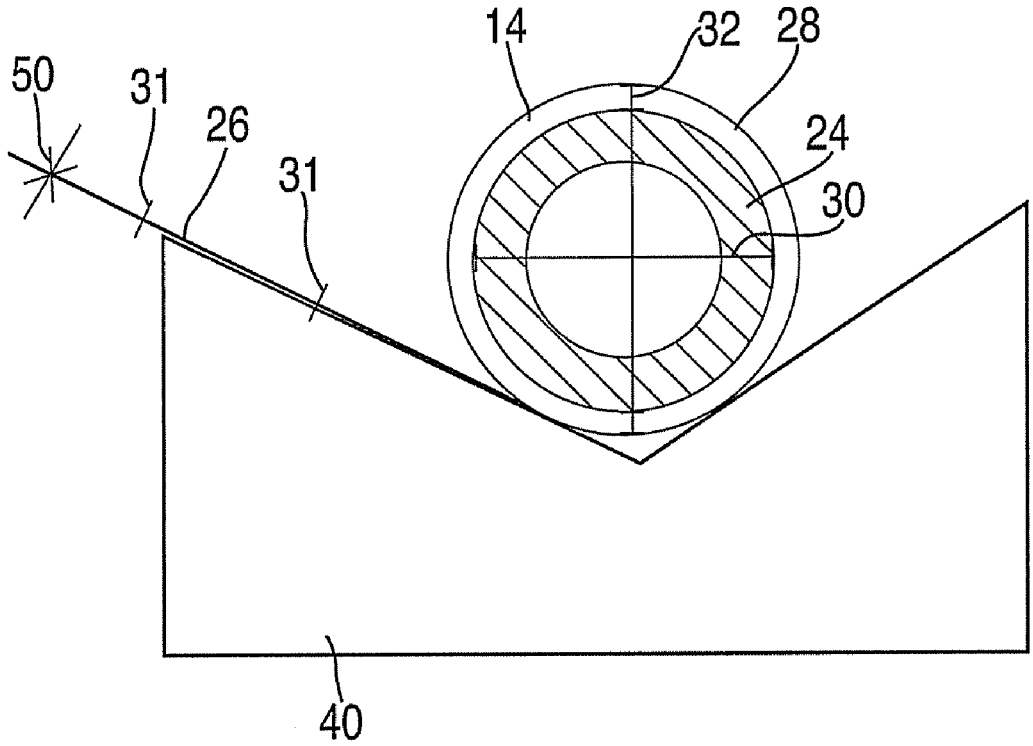
FIG. 3 is a partial schematic of FIG. 2 showing a decreased receipt paper supply.

Referring to FIGS. 1-3, a system 10 for indicating receipt paper supply in a receipt printer 12 is illustrated. The system includes the printer 12, a receipt paper roll 14, a computing resource 15 and an optical scanner 16. As shown in FIG. 1, the scanner 16 is logically associated with the computing resource 15 via a cable 20, and the printer 12 is logically associated with the computing resource 15 (via a connection not shown). It should be appreciated that the paper roll 14 may be any material suitable for being rolled, such as plastic, card stock, etc. It should also be appreciated that though the scanner 16 is illustrated to be logically associated with the computing resource 15 via the cable 20, any manner of logical association may be used in conjunction with or instead of the cable 20, including a wireless connection. It should also be appreciated that the computing resource 15 may be hardware separate from the scanner 16 and printer 12 (as illustrated), or software disposed within the scanner 16 and/or printer 12. It should further be appreciated that the printer 12 may be any device that feeds the rolled material.

Referring particularly to FIG. 2, the receipt paper roll 14 comprises a role core 24 and a length of receipt paper 26 wound around the core 24 to form a rolled paper portion 28 of the roll 14. The core 24 includes an outer core diameter 30, and the rolled paper portion 28 includes an outer paper diameter 32. This outer paper diameter 32 obviously decreases as the paper 26 is removed (unwound) from the paper portion 28 and eventually the core 24 during normal printer operation. As is shown in FIG. 2, the core 24 of the roll 14 is of a darker shade/color 34 than the shade/color 36 of the paper portion 28. This creates a color contrast, particularly at a side 23 of the roll 14 facing the scanner 16. In an exemplary embodiment, and as will be discussed in greater detail below, the optical scanner may be a linear grey scale scanner, and the color contrast may be a grey-scale contrast used by the grey-scale scanner to distinguish between the core 24 and paper portion 28. It should be appreciated that in an alternative embodiment, this grey-scale contrast may also be achieved via lighter shade/color of the core 24, and a darker shade/color of the receipt paper 26. It should also be appreciated that the scanner 16 may be a color scanner that senses a color contrast between the core 24 and paper portion 28, an ultraviolet scanner that senses a UV contrast between the core 24 and paper portion 28, and an infrared scanner that senses an IR contrast between the core 24 and paper portion 28. All of these scanners (including the grey-scale type) may be either linear or two-dimensional.

Referring particularly to FIG. 1, the roll 14 is disposed in a line of sight 38 of the scanner 16. In an exemplary embodiment, the scanner 16 is grey-scale and scans at approximately 100 to 1200 dots per inch (dpi), though scanners that scan at resolutions of higher or lower dpi may also be used. The scanner 16 may be portable, stationary, a stand-alone piece of hardware, or disposed on/within the computing resource 15 or printer 12. As shown in the Figures, the roll 14 may be held in place with the printer via a roll holder 40. It should be appreciated that the roll holder 40 shape may be different than a V-shape bucket shown in FIGS. 1 and 2. The roll 14 may also be held in place with the printer 12 via a spindle (not illustrated) extending through an opening in the core 24. The computing resource 15, is programmed with information describing the shape of the roll holder 40, or alternatively the spindle location, and the distance to the scanner 16.

As mentioned above, the scanner 16 may be an optical grey-scale scanner. Thus, grey-scale contrast between the core 24 and paper portion 28 is used by the grey-scale scanner 16 to sense where the core 24 ends and the paper portion 28 begins. Sensing of this contrast may be accomplished regardless of the size of the core diameter 30. In addition, the scanner 16 senses contrast between an outermost extent (i.e. the outer paper diameter 32) of the paper portion 28 and any environment that may be surrounding the outermost extent of the paper portion 28. This contrast may be sensed because there is no surface beyond the outermost extent to reflect light back into the scanner, and thus, area beyond the outermost extent will be represented as a black or very dark area (in contrast to the paper roll portion 28) in any image created by the scanner 16. Using these grey-scale contrasts, the scanner 16 senses what areas are occupied by both the core 24 and the decreasing (with printer use) paper portion 28.

As the scanner 16 senses data pertaining to the areas occupied by both the core 24 and the decreasing paper portion 28, the data is transmitted to the computing resource 15 via (in this embodiment) the logically associating cable 20. The computing resource 15 is configured to convert this data into measurements pertaining to core diameter 30 and decreasing paper diameter 32. As paper diameter decreases, the roll 14 drops relatively lower into the roll holder 40. Using data pertaining to paper diameter 32 and core diameter 30 (as sensed by the sensor 16), and information describing the shape of the roll holder 40 and the relationship between a relative center of the paper roll 14 and the paper diameter 32, the computing resource 15 compensates for this relative drop of the paper roll 14, and maintains accurate calculations of the decreasing outer paper diameter 32, as well as the core diameter 30. Alternatively, if the core diameter 30 is known, the computing resource 15 can be programmed with this information to eliminate the need to calculate the core diameter 30.

As receipt paper 26 is fed through the printer 12, data pertaining to the amount/length of paper that has been fed into the printer 12 is also transmitted to the computing resource 15. The computing resource 15 couples this "paper fed" data with at least two successive measurements of the decreasing outer paper diameter 32 (along with measurements of the core diameter 30) to calculate measurements of paper thickness 50. The computer may make this paper thickness 50 calculation via an equation incorporating knowledge of the decrease in paper diameter 32 between the successive measurements and the knowledge of the amount of paper fed to achieve this decrease. The ability to calculate paper thickness 50 in this manner eliminates a user's need to program the printer 12 or computing resource 15 to include information pertaining to paper thickness, which may vary (1.8 to 5.0 mils) from roll to roll. Alternatively, if the paper thickness 50 is known, the computing resource 15 can be programmed with this information to eliminate the need to calculate the paper thickness.

With the paper thickness 50 of the receipt paper 26 being known, the computing resource 15 can use this knowledge with the measurements of the decreasing outer paper diameter 32, as well as the core diameter 30, to calculate a length of receipt paper 26 left on the roll 14. Thus, a user can set alerts pertaining to low paper conditions based on at least one length 31 of paper left on the roll 14. For example (see FIG. 3), if the user desires an alert when a length 31 of 5 feet of paper is left, he/she could program the computing resource to alert the user at this point. The computing resource 15 may also be programmed give multiple alerts at multiple lengths 31 of remaining paper (i.e. 5 feet, 10 feet, 15 feet, etc.). Alerts, multiple or single, may be indicated to the user via an alerting device 44 disposed on at least one of the computing resource 15, printer 12, or sensor 16, the alerting device 44 being a device such as an audio device, a visual indicator, or a display screen.

Figure 4:
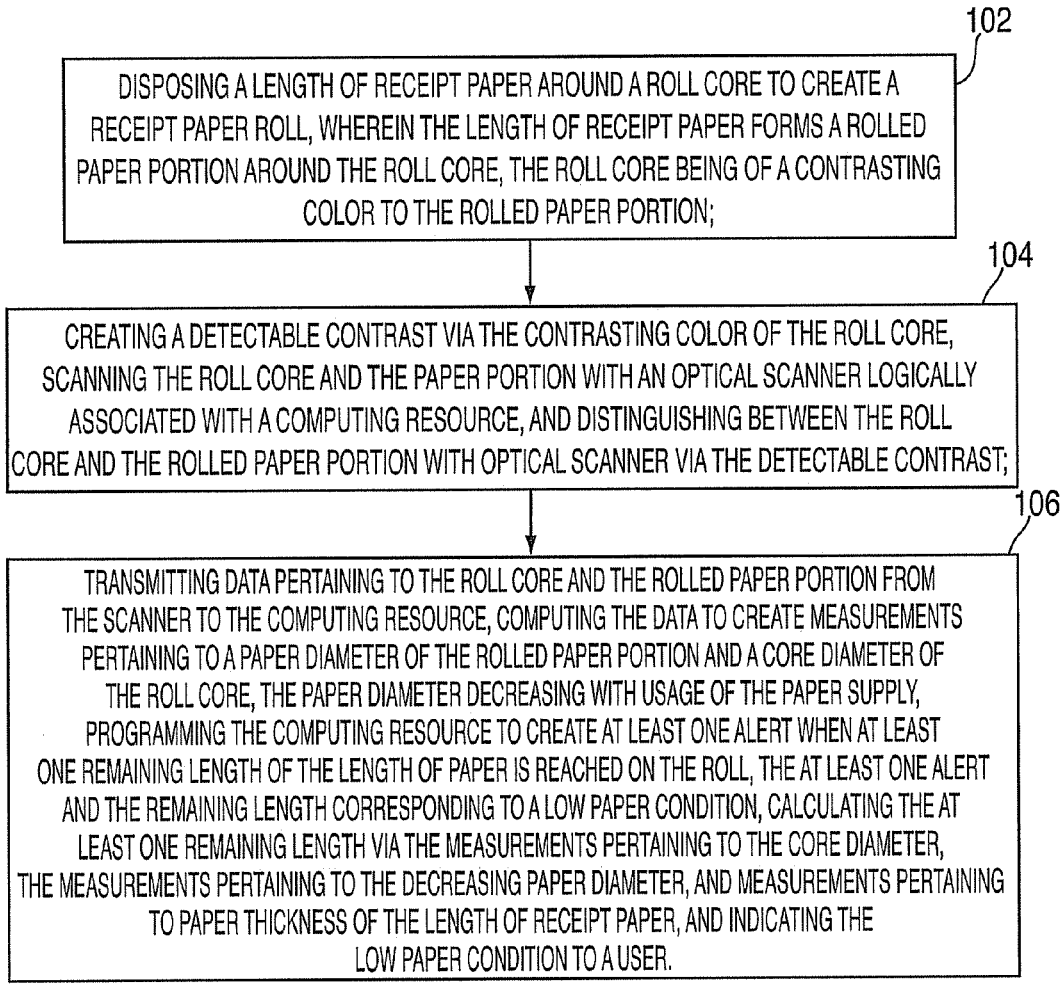
FIG. 4 is a block diagram illustrating a method for indicating receipt paper supply in a receipt printer.

Referring to FIG. 4, a method 100 for indicating receipt paper supply in a receipt printer 12 is illustrated, the method including disposing a length of receipt paper 26 around a roll core 24 to create a receipt paper roll 14, wherein the length of receipt paper 26 forms a rolled paper portion 28 around the roll core 24, the roll core 24 being of a contrasting color 34 to the rolled paper portion 28, as shown in operational block 102. The method 100 also includes creating a detectable contrast via the contrasting color 34 of the roll core 24, scanning the roll core 24 and the paper portion 28 with an optical scanner 16 logically associated with a computing resource 15, and distinguishing between the roll core 24 and the rolled paper portion 28 with the optical scanner 16 via the detectable contrast, as shown in operational block 104. The method 100 further includes transmitting data pertaining to the roll core 24 and the rolled paper portion 28 from the scanner 16 to the computing resource 15, computing the data to create measurements pertaining to a paper diameter 32 of the rolled paper portion 28 and a core diameter 30 of the roll core 24, the paper diameter 32 decreasing with usage of the paper supply, programming the computing resource to create at least one alert when at least one remaining length of the length of paper is reached on the roll, the at least one alert and the remaining length corresponding to a low paper condition, calculating the at least one remaining length via the measurements pertaining to the core diameter 24, the measurements pertaining to the decreasing paper diameter 32, and measurements pertaining to paper thickness 31 of the length of receipt paper 26, and indicating the low paper condition to a user, as shown in operational block 106.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A method for indicating receipt paper supply in a receipt printer, the method comprising:

disposing a length of receipt paper around a roll core to create a receipt paper roll, wherein said length of receipt paper forms a rolled paper portion around said roll core, said roll core being of a contrasting color to said rolled paper portion;

creating a detectable color contrast between said roll core and said rolled paper portion via said contrasting color of said roll core;

scanning said roll core and said paper portion with an optical scanner logically associated with a computing resource;

distinguishing between said roll core and said rolled paper portion with said optical scanner via said detectable color contrast;

transmitting data pertaining to said roll core and said rolled paper portion from said scanner to said computing resource; computing said data to create measurements pertaining to a paper diameter of said rolled paper portion and a core diameter of said roll core, said paper diameter decreasing with usage of the paper supply;

programming said computing resource to create at least one alert when at least one remaining length of said length of paper is reached on said roll, said at least one alert and said remaining length corresponding to a low paper condition;

calculating said at least one remaining length via said measurements pertaining to said core diameter, said measurements pertaining to said decreasing paper diameter, and measurements pertaining to paper thickness of said length of receipt paper;

alerting said low paper condition to a user; and computing said measurements pertaining to thickness of said length of receipt paper using paper fed data transmitted from the printer, at least two of said measurements of said decreasing paper diameter, and said measurement of said core diameter, wherein said paper fed data pertaining to length of paper that has been fed into the printer, and said at least two of said measurements of said decreasing paper diameter are taken successively.

2. The method of claim 1, further including adjusting said at least one alert in said computing resource to correspond to a specific application for the printer.

* * * * *